United States Patent [19]

Fengler

[11] Patent Number: 4,656,764

[45] Date of Patent: Apr. 14, 1987

[54] SHEETHOLDER

[76] Inventor: Horst Fengler, Scharnhorststr. 10a, 4902 Bad Salzuflen, Fed. Rep. of Germany

[21] Appl. No.: 765,608

[22] Filed: Aug. 14, 1985

[30] Foreign Application Priority Data

Aug. 17, 1984 [DE] Fed. Rep. of Germany ... 8424369[U]

[51] Int. Cl.[4] ..... G09D 3/02

[52] U.S. Cl. ..... 40/122; 40/107; 40/341; 40/352; 40/152.1

[58] Field of Search ..... 40/122, 107, 109, 110, 40/155, 154, 122, 5, 352, 341, 152, 489

[56] References Cited

U.S. PATENT DOCUMENTS

| | | | |
|---|---|---|---|
| 424,356 | 3/1890 | Romaine | 40/122 |
| 1,065,613 | 6/1913 | Jacobus | 40/122 |
| 1,427,850 | 9/1922 | Reed | 40/122 |
| 1,559,459 | 10/1925 | Rogers | 40/352 |
| 2,094,017 | 9/1937 | Lilly | 40/352 |
| 2,530,437 | 11/1950 | Marks | 40/352 |
| 2,550,386 | 4/1951 | Shepard | 40/122 |
| 2,647,834 | 8/1953 | Rabkin | 40/154 |
| 2,828,564 | 4/1958 | Barbin | 40/122 |
| 2,845,732 | 8/1958 | Nichols | 40/122 |
| 2,892,275 | 6/1959 | Woofter | 40/122 |
| 2,981,231 | 4/1961 | Howard | 40/352 |
| 3,114,552 | 12/1963 | Flower | 40/155 |
| 3,142,920 | 8/1964 | Nelson et al. | 40/122 |
| 4,024,662 | 5/1977 | Krulwich | 40/352 |
| 4,329,799 | 5/1982 | Nagley | 40/110 |
| 4,365,431 | 12/1982 | Klaus et al. | 40/352 |
| 4,455,773 | 6/1984 | Denison | 40/352 |

FOREIGN PATENT DOCUMENTS

| | | | |
|---|---|---|---|
| 2219967 | 11/1973 | Fed. Rep. of Germany | 40/110 |
| 3121574 | 12/1982 | Fed. Rep. of Germany | 40/110 |
| 238529 | 7/1945 | Switzerland | 40/110 |
| 1060918 | 3/1967 | United Kingdom | 40/110 |

*Primary Examiner*—Gene Mancene
*Assistant Examiner*—J. Hakomaki
*Attorney, Agent, or Firm*—Erwin S. Teltscher; Peter R. Ruzek

[57] ABSTRACT

A base which is adapted to hold a pile of similarly dimensioned sheets includes a substantially flat and rectangular holder, which defines two parallel and normally horizontally positioned sides, and a frame which may be attached to, and surround the holder. The holder is formed with normally upright rim strips, and the frame covers the rim strips. Each rim strip is formed with a guide slot; a bar of transparent material is disposed in parallel with the horizontally positioned sides, and is slidable along the holder in a direction substantially perpendicular to the horizontally positioned sides. The frame is formed with recesses in the region of the guide slots, so as to accommodate the slidable bar, and each recess in the frame, and each guide slot corresponding thereto is located in a center region of a corresponding rim strip, and extends along about one third along a length thereof. The bar has bent over end portions engaging the guide slots, respectively, and a frame-like slider is glidably disposed on the bar.

1 Claim, 5 Drawing Figures

SHEETHOLDER

FIELD OF THE INVENTION

The invention relates to a housing for a stack of sheets of equal dimensions, such as calendar sheets, diagrams, graphic illustrations, photos or the like.

BACKGROUND OF THE INVENTION

With the aid of the invention it is required to devise a housing or bar in a compact closed form of a cassette, which is suitable for accommodating sheets as information carriers of various types. Here certain arbitrarily selected surface segments are to be particularly emphasized by a displaceable framing slidable bar.

SUMMARY OF THE INVENTION

This task is solved, according to the invention, by a housing, which includes a flat rectangular receiving holder closable by a frame frame-shaped cover, on which there is disposed a slidable bar extending at right angles to two horizontal sides of the rectangle. Preferably there is disposed a longitudinally displaceable frame-shaped slider on the sliding bar. In this manner a surface segment of the uppermost sheet of the pile of sheets accommodated in the housing, for example the number corresponding to a calendar date in a calendar sheet, can be marked, and consequently the calendar can be set to the desired date.

The inventive housing is suitable, for example, for accommodating twelve three-month sheets, and wherein each sheet contains in three partial regions disposed above one another the respective day numerals of a month. In the field of view of the housing there appear then in the upper third the numbers of the day of the past month, in the middle third the numbers of the day of the present month, and in the lower third the numbers of the day of the following month. In this manner there arises a three-month calendar, by means of which an advantageous planning of dates is possible. By attaching a stand to the rear side of the housing, the housing can be set upon a table surface, while on its rear side simultaneously there is provided a suspension lug, so that the housing can also be suspended from a wall. Finally the rear side, on a large part of its surface, is formed by a flat wall, which can serve as an adhesive surface. In this manner the housing can, for example, also be glued into a notebook.

Below the viewing opening of the frame-shaped cover, the cover is provided with an advertising surface, so that an advertising print or writing can be added thereto. This provides advantages for any advertisement, to the extent that the calendar sheets need no longer be imprinted with advertising matter. When the housing is used as a calendar, also calendar sheets can be received therein, which are imprinted both on the front side as well as on the rear side. In this manner the use of the holder is increased to two years. After the useful lifespan is terminated, the pile of calendar sheets can be replaced very simply, so that the calendar housing can be used for many years.

The housing can be made in a favorable shape, and can be shaped as an elegant, compact, and closed form of a cassette, so that it is also possible to accommodate photos or other illustrations therein. Finally it is even possible to accommodate in the housing a rectangular mirror, which consequently is surrounded by a pleasant frame, is protected against any risk of breakage, and can also be placed on a surface, or be suspended from a wall.

Advantageous implementation forms of the invention are contained in the protective claims. The scope of protection extends not only to the claimed individual features, but also to their combination.

DESCRIPTION OF THE DRAWING

An embodiment example of the invention is shown in the drawing and is described in what follows in more detail, there being shown.

DESCRIPTION OF THE PREFERRED EMBODIMENTS

Figure 1:
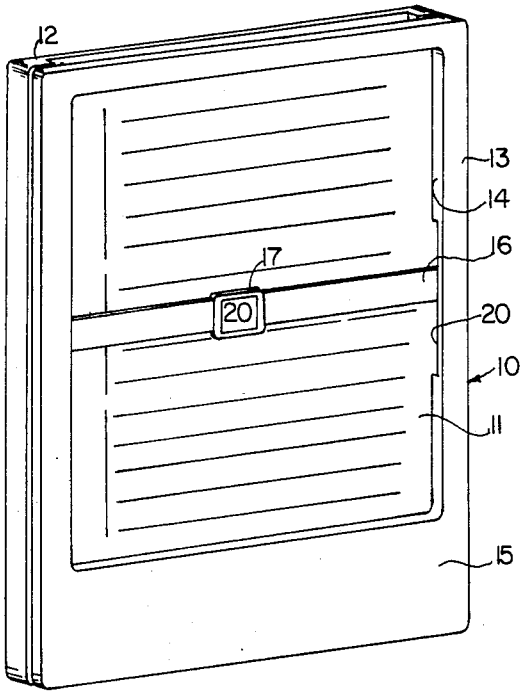
FIG. 1 is a perspective view of a housing with a pile of sheets accommodated therein.
Figure 2:
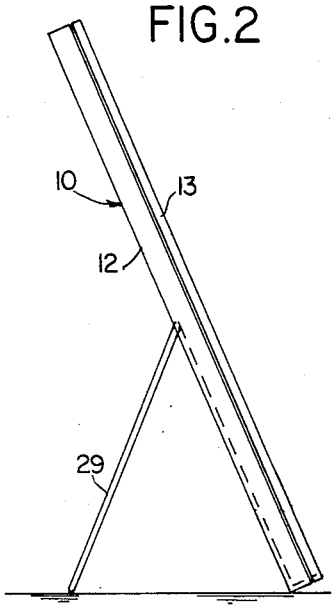
FIG. 2 is a side view of a housing placed on a table.
Figure 3:
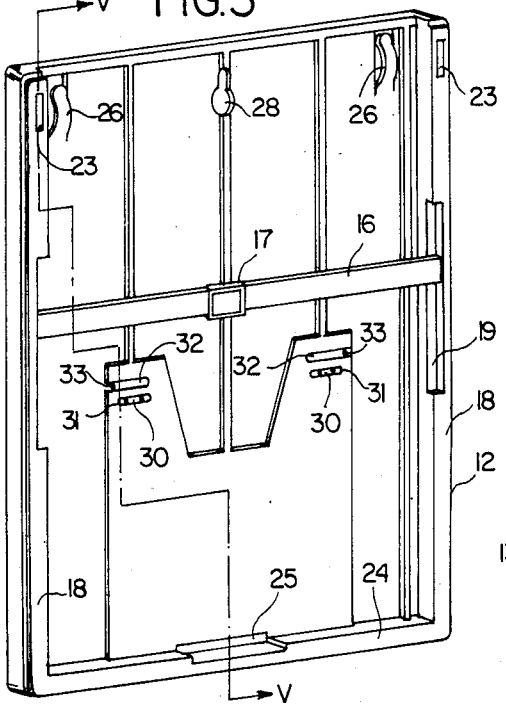
FIG. 3 is a perspective interior view of the receiving holder of the housing.
Figure 4:
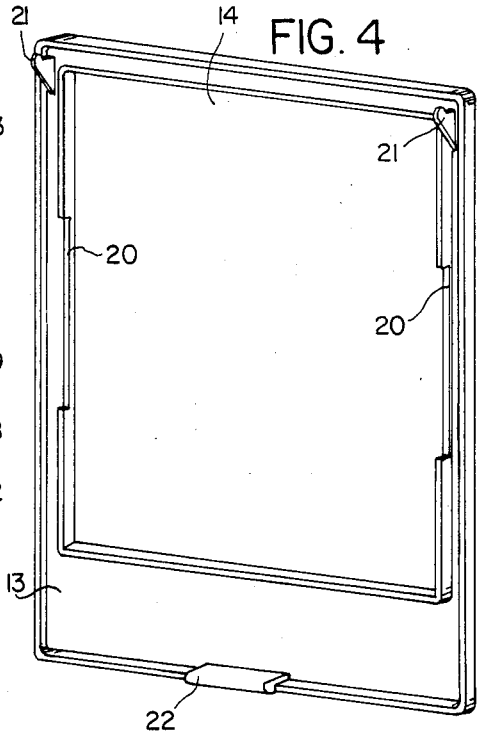
FIG. 4 is a perspective bottom view of the cover of the housing.
Figure 5:
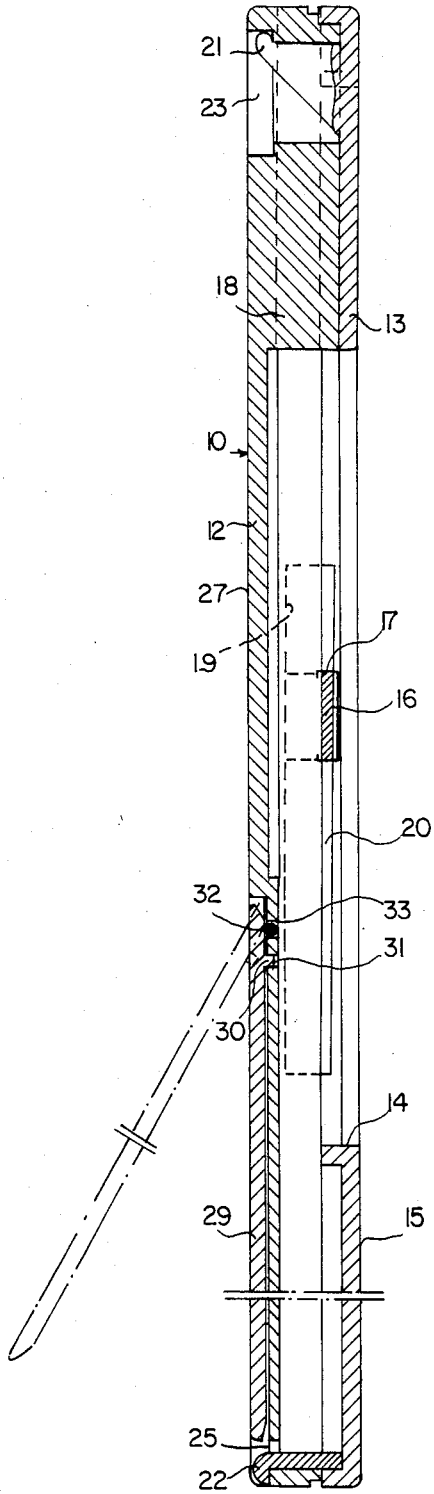
FIG. 5 is a perpendicular cut along the line V—V through the housing disposed vertically, for example suspended from a wall.

The inventive housing or holder 10 for receiving a pile 11 of sheets or equal dimensions consists of a receiving holder 12 with a frame or frame-shaped cover 13, wherein both may be made of synthetic material. The cover 13 is formed with a rectangular opening 14, through which the uppermost sheet of the pile 11, accommodated in the receiving holder 12, can be viewed. Below the opening 14 there is provided on the cover 13 an advertising surface 15, on which the desired advertising information can be provided.

In front of the cavity of the receiving holder 12 there is disposed a horizontally displaceable sliding bar 16, on which there is located a slider 17, which is displaceable in a longitudinal direction, namely horizontally. The slidable bar 16 may consist of a transparent material, so that the imprint of the uppermost sheet of the pile can be viewed through the slidable bar 16. The slider 17 surrounds a certain portion of the imprint, and may consist either of a transparent material with a rectangular or quadratic frame mounted thereon, or may merely consist of a frame-shape element itself.

For the attachment, and vertically slidable displacement of the slidable bar 16, the receiving holder 12 is formed with vertical rim strips 18, in which there are formed vertical guide slots 19. Both ends of the slidable bar 16 are bent over and fitted into the guide slots 19. The guide slots 19 may also be formed with indentations, so that the slidable bar 16 may be snapped thereinto selectively, so as to appear on several horizontal lines disposed above one another. When the housing 10 is used as a three-month calendar there can be provided, for example, for the center month five lines of dates of the month so that the slidable bar 16 can always be positioned in one of the five lines, and therefore maintained thereat.

In the exemplified embodiment the rectangular field exposed by, and to be viewed through the opening 14 of the cover 13 is subdivided into three parts, and wherein the horizontal slidable bar 16 during its vertically parallel displacement slides only along the center portion. In the vertical frame portion of the cover 13 there are provided corresponding vertical recesses 20, which are disposed in the center of each frame portion, and extend along a third of its length. These recesses 20 are required for slidability of the slidable bar. The vertically disposed guide slots 19 of the upright rim strips 18 of the receiving container 12 also correspond in their length and placement to the respective recesses 20.

For attachment of the cover 13 to the receiving holder 12 there are provided on the upper corners of the cover 13 projections 21, extending from its rear side, and a resilient plug or spring 22 provided in the region of the lower edge and extending from the rear side. The projections 21 are inserted for securement into vertical receiving slits 23 and maintained thereat, which slits, in turn, are formed in respective upright rim strips 18 of the receiving holder 12. An indentation 25 is provided in a lower horizontal rim strip 24 of the receiving holder 12, into which the resilient spring 22 fits, when the cover 13 is placed on the receiving holder 12.

Within the receiving holder 12 there extend two resilient tongues 26, which start from the rear wall of the receiving holder 12. These press the pile of sheets received in the receiving holder 12 towards the frame-shaped cover 13, so that the pile of sheets 11, and consequently also the uppermost sheet to be viewed always have an unambiguous position in the housing 10.

The housing 10 may both be set upon a surface, be suspended from a vertical wall, as well as be glued onto a flat surface. For this purpose the larger portion of its rear side is formed as a flat wall 27, so as to result in an adhesive surface. In this portion there is provided a through-going suspension opening 28 in the rear side in the vicinity of the upper horizontal edge of the receiving holder 12. Here the housing 10 can therefore be suspended from a hook on a wall. In the lower portion of the rear side of the housing 10 there is provided in a clearance an outwardly pivotable stand 29, with the aid of which the housing 10 can be positioned in an inclined position on a horizontal surface. The stand 29, in its collapsed position, does not extend beyond the plane of the wall 27, so that it is not an obstacle to optionally glue in the housing 10 to any surface. In the collapsed position the stand 29 is maintained by dogs 30 projecting towards the interior side of the receiving holder, which are inserted into respective slits 31 of the receiving container 12. So that the stand 29 can be pivotably extended, it includes two aligned and horizontally extending pivotable pins 32, which project from each side, are inserted through respective slits 33 of the receiving holder 12, and consequently are supported therein. These pivotable pins 32 are disposed in the region of the upper edges of the stand 29, which are slanted and therefore form a stop limiting the largest pivoting motion.

I claim:

1. A base adapted to hold a pile of similarly dimensioned sheets comprising, in combination:

a substantially flat and rectangular holder made of synthetic material, and defining two parallel and normally horizontally positioned sides, a lower and normally horizontally positioned rim strip being formed on said holder, and having an indentation, said holder being formed in a lower rear region thereof with a clearance, a substantially flat stand being pivotably connected to said holder, and being disposed in a collapsed position thereof in said clearance, while being outwardly extendable from said holder, two normally horizontally disposed pins pivotably extending from said stand, said holder being formed with bores aligned to pivotably receive said pins, respectively, said stand having two forwardly projecting dogs snapping into respective slits formed in said holder on a rearside thereof, when said stand is in said collapsed position, a frame attachable to said holder, said holder being formed with normally upright rim strips, said frame covering said upright rim strips, each upright rim strip being formed with a guide slot and a slit, said frame being formed in upper corner regions thereof with two projections extending rearwardly therefrom, resiliently formed tongues formed on a rearside of said holder, projecting forwardly thereinto, and being adapted to press said sheets against said frame, a bar of transparent material disposed in parallel with said horizontally positioned sides and being slidable along said holder in a direction substantially perpendicular to said horizontally positioned sides, said frame being formed with recesses in the region of said guide slots, so as to accomodate said slidable bar, each recess in said frame, and each guide slot corresponding thereto being located in a center region of a corresponding upright rim strip, and extending about one third along a length thereof, a plug resiliently mounted on said frame on a lower side thereof, and being press-fitted into said indentation, so as to be releasably connected to said lower and normally horizontally positioned rim strip of said holder, said projections formed in said upper corner regions of said frame being releasably engaged in respective of said slits formed in the upright rim strips of said holder, said bar having bent over end portions engaging said guide slots, respectively, said frame surrounding said holder so as to cover the bent over end portions of said bar engaging said guide slots, and a frame-like slider glidably disposed on said bar.

* * * * *